United States Patent [19]

Smith

[11] 4,050,678

[45] Sept. 27, 1977

[54] CONTAINERIZED LIQUID STIRRER

[76] Inventor: Charles S. Smith, 2842 Merton Ave., San Diego, Calif. 92111

[21] Appl. No.: 637,364

[22] Filed: Dec. 3, 1975

[51] Int. Cl.[2] ..... B01F 11/00

[52] U.S. Cl. ..... 366/130; 366/343; 366/605

[58] Field of Search ..... 259/76, 77, 80, 116, 259/117, DIG. 38; 220/90; 206/219

[56] References Cited

U.S. PATENT DOCUMENTS

| | | | |
|---|---|---|---|
| 832,168 | 10/1906 | Schopflacher | 206/219 |
| 1,353,443 | 9/1920 | Wilson | 259/116 |
| 2,392,731 | 1/1946 | Fox | 259/DIG. 38 |
| 2,644,183 | 7/1953 | Kellett | 220/90 |
| 3,241,819 | 3/1966 | Taylor | 259/76 |

*Primary Examiner*—Harvey C. Hornsby
*Assistant Examiner*—Robert Pous
*Attorney, Agent, or Firm*—Ralph S. Branscomb

[57] ABSTRACT

A liquid stirrer for containerized liquids and particularly paint comprises a spanner bar having lips on each end thereof to engage between a container rim and lid, and a preferably semi-flexible blade structure depending from the spanner bar and extending into the liquid container such that reciprocating rotation of the paint can effects stirring of the liquid therein.

3 Claims, 5 Drawing Figures

CONTAINERIZED LIQUID STIRRER

BACKGROUND OF THE INVENTION

The invention is a device for mixing liquids having dissolved or emulsified ingredients which have precipitated or fallen out of solution, such as the thick pigment sludge which is found beneath the layer of solvent in paint cans which have been shelved for a period of time.

That the separating of components of paint and other liquids presents a remixing problem is common knowledge. Conventionally remixing has been accomplished by the devotion of considerable time and effort to stirring with a familiar paint stirring stick, although a number of other devices have been developed which normally either rest loosely in the can or penetrate the container and are crank or spindle operated externally of the can. There is a need, however, for a paint stirring device of sample and economical design which does not puncture the container and has no moving parts, but is affixed inside the can and causes the liquid to be stirred by its own inertia as the can is rotated.

SUMMARY OF THE INVENTION

The stirrer of the present invention fulfills the above recognized need and is utilized by removing the lid from a can or jar of paint or other liquid to be mixed, placing the stirrer in the liquid such that the curved ends of a spanner bar rest across the container rim, and then reaffixing the lid. A pair of parallel blades extend into the liquid from the spanner bar terminating in a transverse blade such that the outer perimeter of the blade structure is closely adjacent to the interior surface of the container. The structure may be made of metal, plastic, or the like and it is preferable that the parallel blades adjacent the sides of the container to be semi-flexible, so that as the container is spun in a reciprocating fashion, the inertia of the liquid therein causes relative rotational movement between the liquid and the blades, and the force of the liquid on the semi-flexible blades causes the parallel blades to twist in opposite directions so that a vertically effective force is applied to the different components of the mixture.

DETAILED DESCRIPTION OF THE PREFERRED EMBODIMENT

Figure 1:
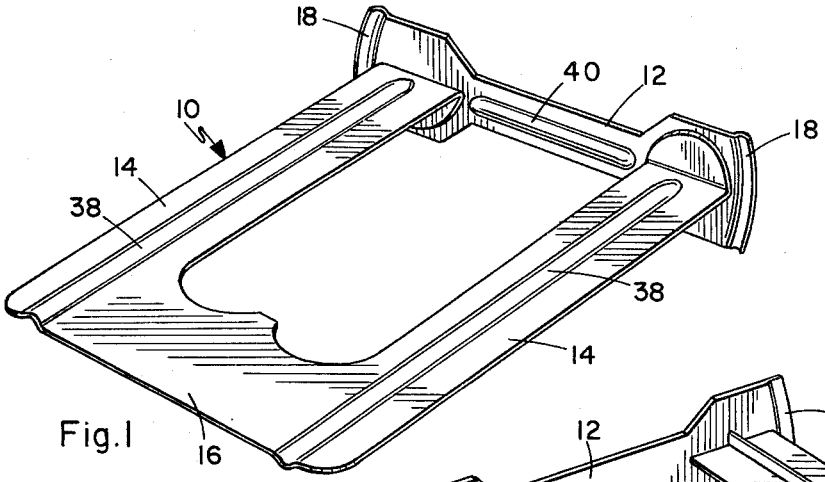
FIG. 1 is a perspective view of one form of the mixing blade suitable for construction from metal.

The stirrer is shown generally at 10 and comprises a spanner bar 12 having a pair of parallel blades 14 extending orthogonally from the spanner bar and terminating in a transversed blade 16 to define a spatula-like stirring element. The stirrer illustrated in FIG. 1 is of metallic construction and is provided at the ends of the spanner bar with downwardly cupped lips 18.

Figure 3:
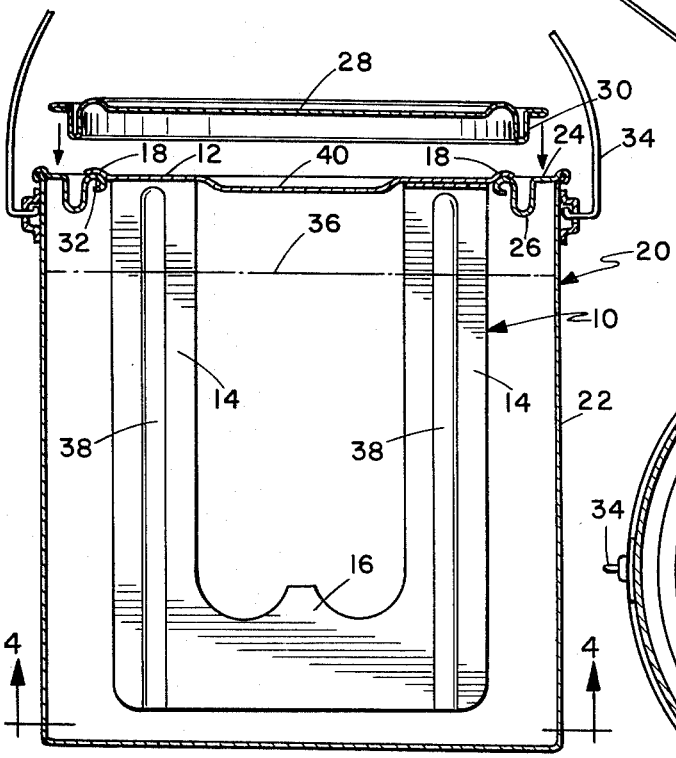
FIG. 3 is a vertical sectional view of a typical paint can with the mixing blade installed.

Referring to FIG. 3, a container 20 which is illustrated as a familiar paint can has a body portion 22, an upper rim 24, the rim defining an annular groove 26 into which lid 28 is frictionally engaged by means of a tongue 30 formed in the lid. Just inwardly of the groove 26 is an annular shoulder 32, and as can be seen in FIG. 3, the lips 18 of the stirrer are shaped to conform to the contour of the shoulder such that they can rest thereon as illustrated and the lid 28 can be snapped into place firmly securing the stirrer by means of its lips between the body portion of the paint container and the lid.

Figure 4:
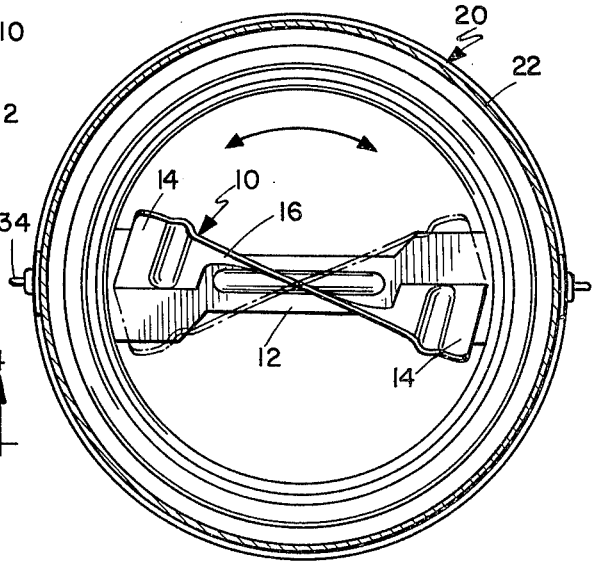
FIG. 4 is a sectional view taken on line 4–4 of FIG. 3, showing the twisting action of the blade.

The paint can has a conventional wire hoop handle 34 so that to mix the paint, after the lid has been removed, the stirrer is inserted and the lid reaffixed to the body portion of the container, the container is reciprocated about is vertical axis by means of the handle or otherwise and the paint or other liquid 36 is thus stirred by the stirrer due to its own inertia. Since the settling action in the liquid results in a vertical stratification, it is desirable that the stirrer have a vertical fanning action as well as applying rotational forces, and this effect is achieved in a simple and economical fashion by gauging the strength of the parallel blades 14 such that they are semi-flexible, resulting in the twisting action as indicated in FIG. 4 such that each blade will cause a downward thrust on the liquid it encounters, resulting in upward thrusts occurring in other areas of the can.

Other details of the stirrer includes longitudinally extended formed ribs 38 in the metal version which reinforce the parallel blades and cause them to be twisted near the spanner bar so that they remain essentially straight and thus provide a generally uniform downward force on the liquid. An additional rib 40 may be formed in the spanner bar to provide reinforcement for that member.

Figure 2:
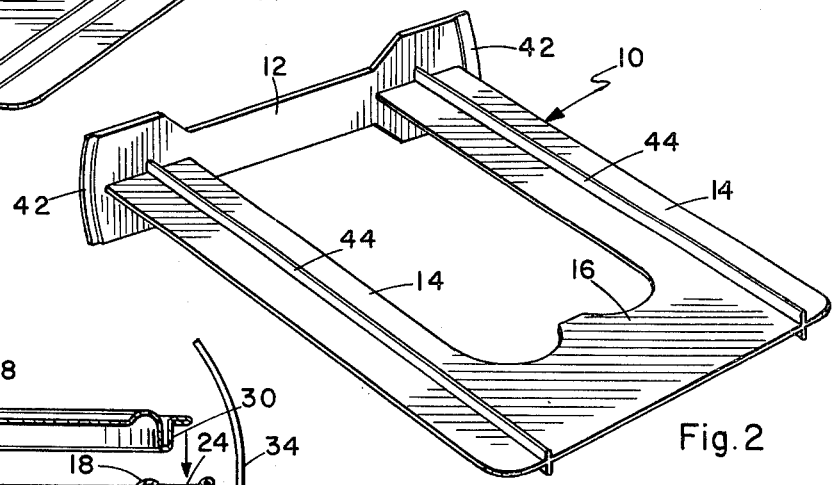
FIG. 2 is a perspective view of the mixing blade as made from plastic.
Figure 5:
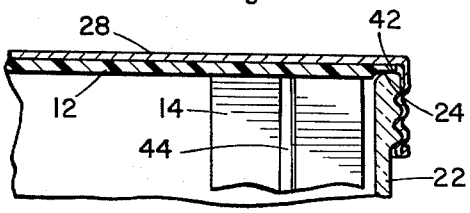
FIG. 5 is an enlarged sectional view showing the engagement of the plastic blade with the mouth of a screw-top container.

The embodiment of the invention illustrated in FIG. 2 is nearly identical to that of FIG. 1 but is of plastic construction and is modified somewhat for this reason. The lips 42 of the plastic version are shorter and not cupped as are the lips 18 for reasons of strength and the ribs 44 are molded extensions of the blades rather than being formed directly therein. FIG. 5 illustrated the stirrer of FIG. 2 used in a jar, the lid 28 of the jar being screwed to the body portion 22 rather than being snapped on, and the lips 42 are more or less wedged between the rim 24 and the lid. However, clearly the embodiments of FIGS. 1 and 2 should be used interchangeably in jars or cans with equal ease as the structure of the container engaged by the stirrer will be identical in both cases.

The invention as described in either embodiment will effectively mix paint, including epoxy paint, and other multiple ingredient liquids without requiring heavy mixing equipment or on-site power. It can be used in almost any liquid container and does not require the puncturing of the container.

I claim:

1. A liquid stirrer for a container having a body portion with a bottom and a rim having an annular shoulder and a removable lid mountable on said rim, said stirrer comprising:

a. a spanner bar removably extendable across a diameter of said annular shoulder and having a lip defined at each end thereof engageable between said annular shoulder and said lid such that said spanner is completely enclosed and firmly secured within a container when engaged by said lid and annular shoulder;

b. a spatula depending from said spanner bar and comprising a pair of generally parallel blades to extend into said container and including a transverse blade joining the distal ends of said parallel blades;

c. said spatula being semi-flexible to yield in use to swirling fluid in said container and extending into said container when said spanner bar is extended across said rim whereby said stirrer can be inserted into and completely enclosed within a container of liquid and captured by said lips between said rim and said lid to permit stirring of said liquid by reciprocal rotation of said can.

2. Structure according to claim 1 wherein said annular shoulder is convex in radial cross-section and said lips are downwardly cupped to conform to and be retained by said shoulder.

3. Structure according to claim 2 wherein said parallel blades are each provided with a longitudinal reinforcing rib to encourage the uniform bending thereof from the ends adjacent the spanner bar.

* * * * *